US006049580A

United States Patent [19]

Bodin et al.

[11] Patent Number: 6,049,580

[45] Date of Patent: Apr. 11, 2000

[54] APPARATUS FOR REMOTE DISMANTLING OF IRRADIATED STRUCTURES

[75] Inventors: François Bodin, Equeurdreville; Georges Lebiez, Tourlaville; Franck Vivier, Virandeville; Ludovic Martin, Rauville-la-Bigot, all of France

[73] Assignee: Compagnie Generale Des Matieres Nucleaires, Velizy Vellacoublay, France

[21] Appl. No.: 09/077,031

[22] PCT Filed: Nov. 28, 1996

[86] PCT No.: PCT/FR96/01886

§ 371 Date: May 14, 1998

§ 102(e) Date: May 14, 1998

[87] PCT Pub. No.: WO97/20323

PCT Pub. Date: Jun. 5, 1997

[30] Foreign Application Priority Data

Nov. 30, 1995 [FR] France ..... 95 14177

[51] Int. Cl.[7] ..... G21C 19/00; G21C 19/42; G21C 17/00

[52] U.S. Cl. ..... 376/316; 376/310; 376/260; 376/248

[58] Field of Search ..... 376/248, 260, 376/310, 316; 83/53, 177, 930; 134/7, 34, 198; 299/17

[56] References Cited

U.S. PATENT DOCUMENTS 4,800,063 1/1989 Mierswa et al. ..... 376/316
5,427,159 6/1995 Burgess et al. ..... 83/177

FOREIGN PATENT DOCUMENTS 2638671 5/1990 France .

OTHER PUBLICATIONS

Database Inspec Institute of Electrical Engineers, Stevenage, GB, Inspec No. AN 524554, Merle; Bader: "High Pressure Wet–Blast Cleaning in Combination With Recycling Technology", XP002011815, voir abrege & Proceedings Kontec 95. "Conditionning of Radioactive Operational and Decommissioning Waste", Mar. 16–17, 1995, Hamburg, Germany, pp. 386–396.

Database Inspec Institute of Electrical Engineers, Stevenage, GB, Inspec No. AN3832154, Drews; Fuchs: "Developement of Measuring and Control Systems for Underwater Cutting of Radioactive Components", XP002011816, voir abrege, & Decommissioning of Nuclear Installations, Oct. 24–27, 1989, Brussels, pp. 201–207.

Database Inspec Institute of Electrical Engineers, Stevenage, GB, Inspec No. AN 3166646, Echert: "Abrasive Water Jet Cutting of Thick Concrete and Water Jet Cleaning for Nuclear Facility Decommissioning and Decontamination", XP002011817, voir abrege & Proceedings of the 1987 International Decommissioning Symposium, Oct. 4–8, 1987, Pittsburg, USA.

Database, Inspec Institute of Electrical Engineers, Stevenage, GB, Inspec No. AN4597124, Harada Et Al: "Reactor Dismanteling by Abrasive Water Jet", XP002011818, voir abrege & JSME International Journal, vol. 36, No. 3, Aout 1993, Japan, pp. 499–504.

*Primary Examiner*—Charles T. Jordan
*Assistant Examiner*—Jack Keith
*Attorney, Agent, or Firm*—Pearne, Gordon, McCoy & Granger LLP

[57] ABSTRACT

The proposed installation comprises an abrasive liquid jet cutting module using a mobile nozzle (25) rotatable in all directions and which also supports a sensor (37) so that it can previously recognize the position or shape of the structure to be cut, a dosimeter (49) to measure its irradiation and a decontamination device (51) to eliminate all excess contamination from it. Cutting residue may be collected by suction. The installation is more universal than previously known installations.

11 Claims, 4 Drawing Sheets

APPARATUS FOR REMOTE DISMANTLING OF IRRADIATED STRUCTURES

DESCRIPTION

This invention relates to an installation for remote dismantling of irradiated structures.

In dismantling operations, and sometimes in maintenance operations on nuclear installations, it is desirable to make remote cuts underwater or above water, of large metallic structures, sometimes contaminated with high activity and with thicknesses of 200 mm or more, usually without the possibility of direct observation. Wherever possible, it is essential to carry out remote cutting operations in order to avoid irradiation that would otherwise be experienced by the operators. This means that it is necessary to design a tool that is firstly capable of working automatically, and also of recovering particles, chips, debris, aerosols, etc., that are always produced by cutting.

There are several known processes meeting these requirements, two of which are described in French patents 2 638 671 and 2 678 198; as in the invention, they use a high pressure abrasive liquid jet as a convenient and reliable means of cutting very thick parts, and means are provided for moving the cut part in front of the jet; the first of these patents also describes a way of recovering cutting debris and sand used as an abrasive, so that the debris can be poured into barrels where it will be stored for as long as necessary, the sand then being used as a material for coating contaminated debris and particles.

However, these processes have the disadvantages that their cutting capabilities are not sufficient, particularly due to limitations observed on movements of the ejection nozzle and that mean that the installations can only be used on structures of a given shape; and it is perhaps even more annoying to realize that it is sometimes difficult to satisfactorily distribute parts of the structure obtained after cutting in the barrels since some are excessively contaminated, and in this case the only solution (if it is authorized) is to send them to special storage installations at a much higher cost.

The article by Echert "Abrasive water jet cutting of thick concrete and water jet cleaning for nuclear facility decommissioning and decontamination", published in the proceedings of the 1987 international decommissioning symposium (Pittsburgh, USA, Oct. 4 to 8, 1987) describes an installation for dismantling of irradiated structures in which cutting and decontamination operations are carried out successively by independent devices that cannot be used to rationalize decontamination; all that is done is that a uniform and fairly large thickness is torn off the surface of the structure. The article by Drews and Fuchs "Development of measuring and control systems for underwater cutting of radioactive components", published in "Decommissioning of nuclear installations" (EUR 12690, Brussels, Oct. 24 to 27, 1989) describes a device for recognition of the shapes of an immersed part in an installation for dismantling of irradiated structures.

Therefore, the invention essentially refers to the ideas of making the abrasive liquid jet spraying tool more mobile and of adding means of contamination measurement and reduction for the structures to be cut, to the installation.

Another aspect of the invention is the possibility of guaranteeing correct operation by making sure that cutting is done properly; in this case, apart from remote cameras or observation means, it is possible to add a sensor or another structure detector to the installation in order to recognize its position and shape and to adjust the trajectory of the cutting tool, even if initial information supplied by a drawing or other means is available.

It must still be possible to collect cutting residue instead of leaving it scattered around the installation.

To summarize, the invention relates to an installation for dismantling irradiated structures comprising a structure support, a module carrying a cutting head forming part of a pressurized water spraying device and abrasive particles, characterized in that the module can move in front of the structure and is rotatable, and that it carries a structure remote sensor, a dosimeter and a decontamination device.

We will now describe these and other aspects and elements of the invention in more detail, by means of a commentary of the following Figures which are given for illustration purposes and are in no way restrictive:

Figure 5:
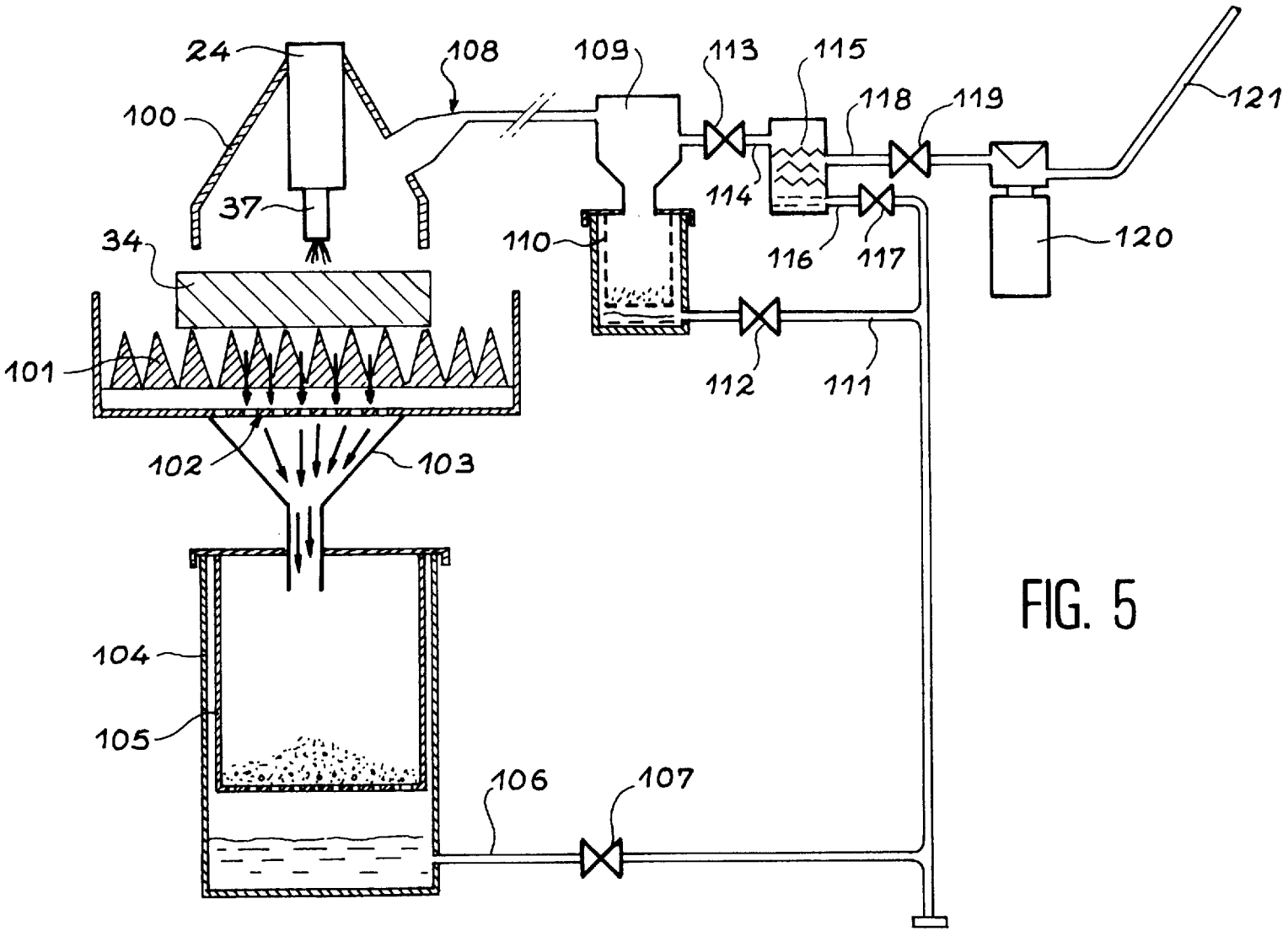

and FIG. 5 schematically illustrates a second embodiment of the invention.

Figure 1:
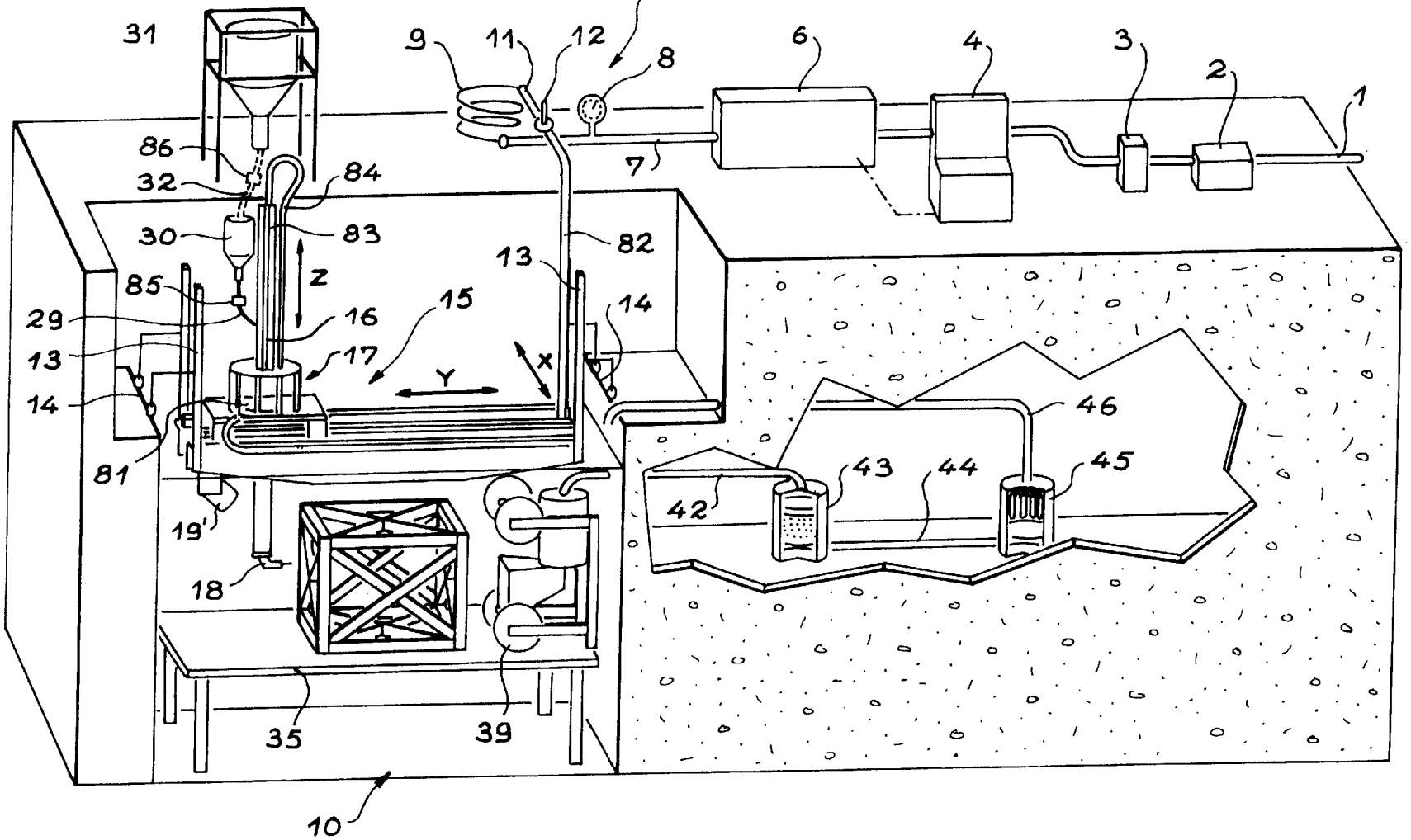
FIG. 1 represents a general layout of a first embodiment of the invention.
Figures 2, 3:
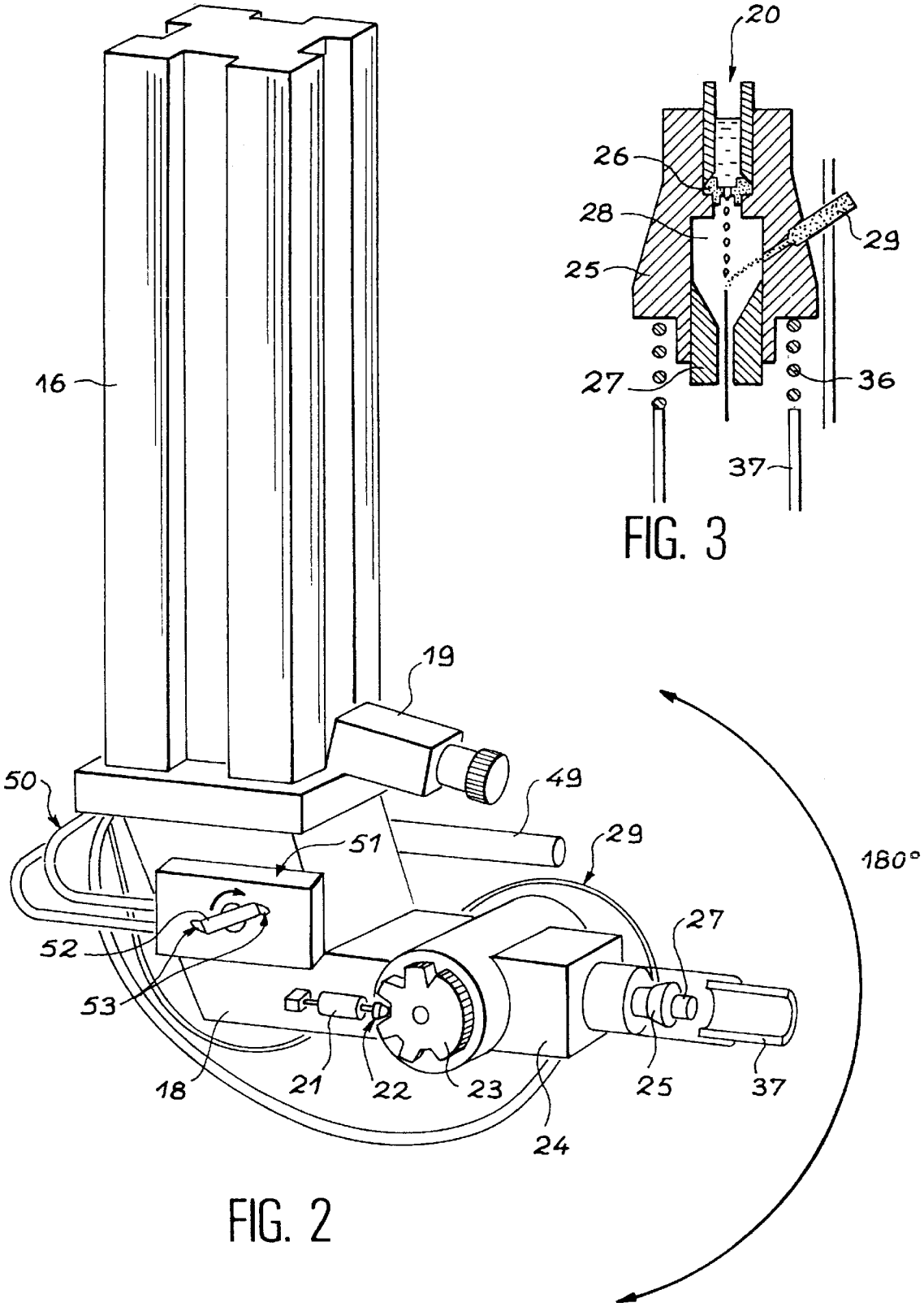
FIG. 2 represents the cutting head.
FIG. 3 is a section through the abrasive liquid jet nozzle.

We will now progressively describe FIG. 1 in relation to FIGS. 2 and 3. The demineralized water used as a cutting agent is supplied through the distribution network installed in the plant to which the installation belongs, through a pipe 1, on which there may be a feed motor pump 2, then a filter bank 3, before a pressure amplifier 6 that increases the water pressure to 4000 bars. The pipe 1 is extended through a high pressure pipe 5 at the outlet from the pressure amplifier 6 comprising, in sequence, a feeder pipe 7 on which there is a pressure checking manometer 8 and a rotating joint 9, followed by a pipe 11 fitted with a valve 12. The purpose of the rotating joint 9 is to make it possible to move pipe 11 with respect to the feeder pipe 7, for reasons which will be described shortly; the pipe 11, the start of which is in open air like other elements of the installation described above, then enters an excavation, the bottom of which forms a pool 10 in which the cutting takes place. In this embodiment, the pool 10 is filled with water to increase safety, but this is not essential if other precautions are taken to protect the outside from contamination; an installation modified to operate out of the water will also be described later.

The excavation wall has two pairs of vertical support arms 13 between which a horizontal platform 15 is thrown. A trolley 17 moves along platform 15, the upper surface of which forms slides extending along the direction denoted Y, and a turret 81 is placed on top of it designed to support a vertical telescopic arm 16 that extends through it. The turret 81 enables the telescopic arm 16 to slide along the vertical Z direction and to rotate through a full circle about this Z direction. The telescopic arm 16 extends below the platform 15 and terminates in a wrist 18 immersed in water in the pool 10. The arms are mobile in a horizontal X direction and perpendicular to the Y direction sliding on rails 14 formed on the excavation wall. Normal mechanisms, not shown, including motor, gear, rack and bearings and sliding pads are used to control these various movements. However, like the rest of the installation, the motors are powered through a control cabinet 4 located above the excavation and manipulated by an operator. Referring to FIG. 2, it can be seen that the lower end of telescopic arm 16 carries a video camera 19 facing obliquely towards the cutting area, immediately above the wrist 18; another video camera, 19' is suspended from the platform 15 behind the wrist 18 and points approximately in the direction of the previous camera to observe execution of the process in more detail.

A high pressure hose 20 runs along the telescopic arm 16 and extends to the wrist 18, terminating in an ejection nozzle 25 at the end of the wrist. This hose 20 forms the end of the high pressure pipe 5. Pipe 11 is actually composed of two rigid segments 82 and 83 fixed to the platform 15 and the telescopic arm 16 respectively, and which are connected through a second rotating joint 84, which like the previous joint 9 consists of a hose segment capable of deforming to suit movements of the installation. The first rigid segment 82 terminates at the first rotating joint 9, and the second terminates at the hose 20. Its flexibility is such that a nozzle holder 24 located at the end of the wrist 18 can be tilted, and it is connected to the wrist 18 by a hinged device equipped with a motor with a watertight housing, and at the outside, with a notched wheel 23 rotating with the nozzle holder 24 in the notches of which a locking pin 22 is pushed by a hydraulic jack 21 fixed to wrist 18. Nozzle 25 is thus placed at the required inclination by action of the motor and is kept in place by the locking pin 22 being inserted in the required notch. This possibility of moving the nozzle holder 24 about a horizontal axis through a half-circle between the two vertical directions, together with the possibility of rotating the telescopic arm 16 about a full circle, makes it possible to move nozzle 25 into any orientation.

The hose 20 terminates in nozzle 25 and, as can clearly be seen in FIG. 3, stops in front of a sapphire or ceramic jet nozzle 26 that has approximately the same cross-section as the water jet that exits from it; a jet guide 27 placed at the exit from the nozzle 25 and separated from the jet nozzle 26 by a chamber 28 retains any erratic drops; and a sand feed duct 29 terminates in chamber 28 oblique to the center line of the jet, the sand mixing with the water jet at this location providing the water jet with an abrasion capacity at the exit from nozzle 25. Refer to FIG. 1 for a description of the remainder of the sand feed network; pipe 29 is the output pipe from a hopper 30 above it, and supported at its top by the telescopic arm 16; the hopper 13 is a small capacity hopper (a few liters) designed to make the feed uniform, and a large hopper above the excavation feeds it through a large cross-section pipe 32. Pipes 29 and 32 are fitted with valves 85 and 86 opened and closed from the control cabinet 4.

The water and sand jet terminate at a structure 34 to be cut, previously placed on a table 35 located above the bottom of the pool 10. An interesting element of the invention is a remote structure senor including an induction sensor terminated by a pipe 37, part of which is a permanent magnet and which extends to the end of the nozzle 24; this sensor, through which the abrasive water jet passes, is used to recognize the shape and position of the structure 34, which is not necessarily known in advance, by contact, the pipe 37 is the moved towards the structure 34 until it touches it at a number of points, the position of which is forwarded to the control cabinet 4. This is done using all available movements of the nozzle holder 24 through mechanisms that connect it to the fixed parts of the installation. The travel distances available in the 3 directions (X, Y and Z) are actually several meters so that the nozzle 25 can rotate around the structure 34; sensors are applied to all faces of the structure when the nozzle holder 24 is rotated in all directions. The contact with the structure 34 is detected by a magnetic sensor fixed to nozzle 25, sensitive to the movement of pipe 37 which is otherwise pushed towards an extended position by a spring 36 located behind it and pressing on the nozzle holder structure 24 around the nozzle 25.

Figure 4:
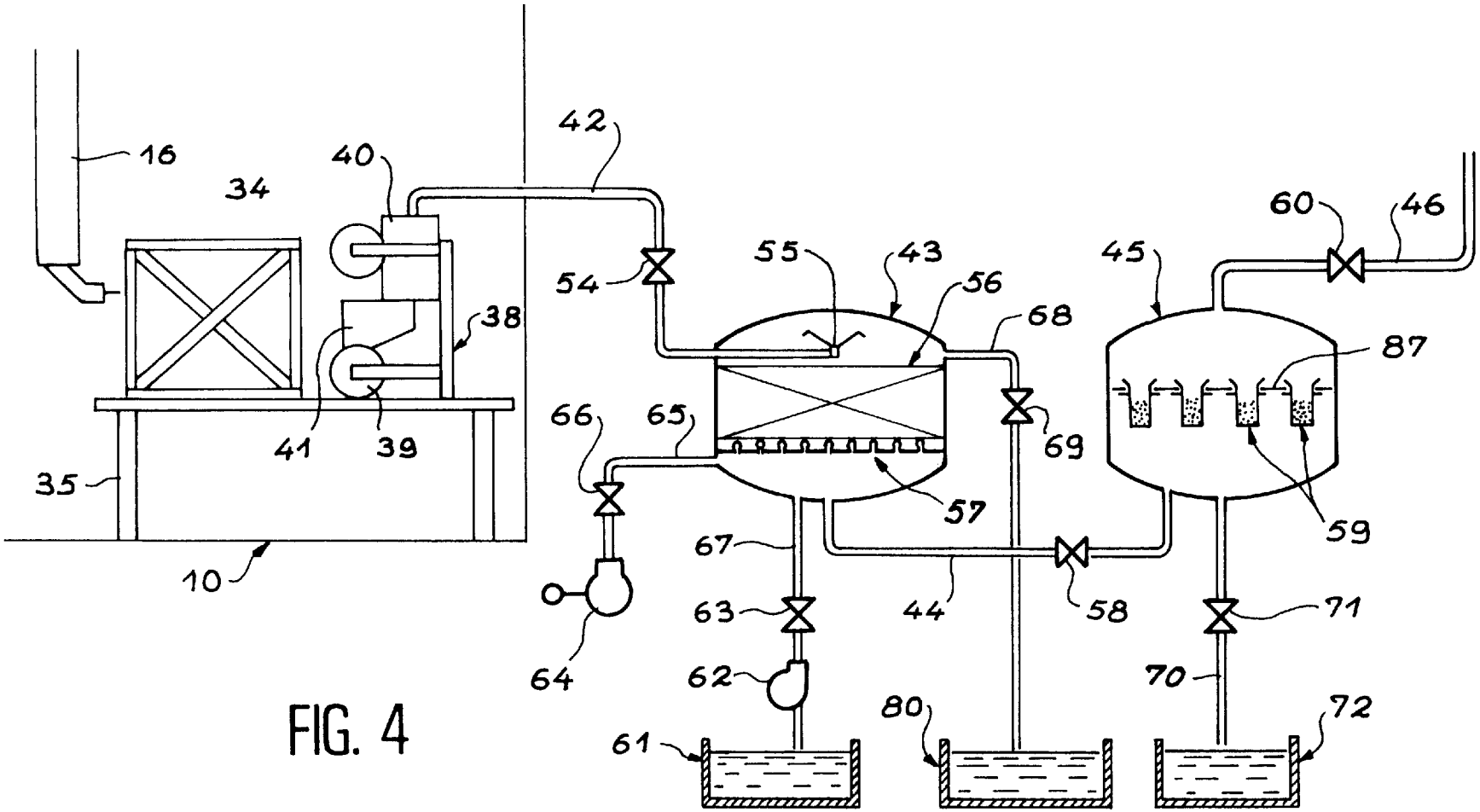
FIG. 4 shows a cutting residue recovery device in more detail.

Therefore the abrasive water jet is sprayed onto structure 34 along a trajectory decided upon by the control cabinet operator 4 and which may take account of drawings of the structure 34, observations by cameras 19 and 19', and operation supplied by the induction sensor. It is known that a liquid at an insufficiently high pressure can easily cut some materials, and that it can even cut very hard and very thick materials of all types if abrasive particles are added to it. However, it is useful to recover these particles and cutting residue as already mentioned. This is done using a device located on the opposite side of structure 34 from nozzle 25 in the line of the water jet, and which consists of a frame 38 carrying wheels 39 that can be used to support and guide structure 34 when it is lowered, and by a pump 40 terminated by a collection hopper 41 opening towards the structure 34 and the jet; water, sand and cutting residue are drawn by pump 40 into hopper 41 and exit out of the pool 10 to flow into a pipe loop, that returns water to the pool 10 after it has been purified and filtered. More specifically, as can be seen in FIG. 4, the pipe loop includes an inlet segment 42 that terminates at a sand filter 43, enters the top of the filter and terminates in a disperser 55 that spreads the water and its contents onto a sand bed 56 covering a distributing sieve 57; water, after its largest particles have been removed (retained by sieve 57 and the sand bed 56) flows to the bottom of the sand filter 43 and passes through an intermediate segment 44 in the pipe loop as far as the bottom of the plug filter 45, in which it rises passing through a sort of strainer 87 perforated with holes occupied by porous cylindrical-shaped cartridges full of ground resin forming filter plugs 59. Perforations enable water to pass through the strainer 87 at the location of filter plugs 59, leaving the last particles behind in the resin; it then enters the pipe loop outlet segment 46 and returns to the pool 10.

However, filters 43 and 45 have to be cleaned periodically to remove impurities that would eventually block them. This is done by isolating them from the rest of the pipe loop by closing valves 54, 58 and 60 located on segments 42, 44 and 46 respectively. The sand filter 43 is cleaned by washing water from a pond 61 and which passes upwards in a washing pipe 67 that leads into the bottom of the filter through the action of a pump 62, after a valve 63 has been opened; the washing water passes upwards through the sand bed 56 and flows into a drain pipe 68 that outlets at the top of the filter 43, and for which the closing valve 69 has been opened. Impurities are entrained and discharged into a settlement tank 80 at the end of the drain pipe 68. The washing efficiency may be increased using a pressurizer 64 connected to the bottom of the sand filter 43, therefore creating an excess air pressure in this filter, through an air duct 65 that closes a valve 66 when not in use:

Plugs 59 are suspended from the strainer 87 by a low strength link. They may be removed, with the impurities contained in them, by sucking them towards another drain pipe 70, for which the closing valve 71 has just been opened; the liquid contents of the plug filter 45 above them drops them through this pipe 70 into another settlement tank 72. New plugs 59 are then installed to replace the old plugs.

We will now illustrate other elements in the wrist 18, with reference to FIG. 2. A dosimeter 49 is directed towards the structure 34 to measure its contamination; depending on the result, a decontamination device 51 may be activated in which the active element is a spinning head 52 formed of a tube terminated at its two opposite ends by two nozzles 53 placed obliquely and in opposite directions, such that water flow through a pipe 50 connected to hose 20 and then passing through the inside of spinning head 52 exerts a rotation torque on it, which makes it spin around the bottom of the decontamination device 51; a rotating water jet is projected at high pressure; obviously, the decontamination device 51 is located such that the jet is never intercepted by elements of the telescopic arm 16, the wrist 18 or the nozzle holder 24, or by elements connected to them. On the contrary, the jet turns in a plane located adjacent to wrist 18 and the nozzle holder 24 and therefore strikes the structure 34 over part of its angular travel, cleaning some of the encrusted radioactive products on it. The decontamination device 51 is beneficially placed in front of the installation and may be placed close to the nozzle 25. Similarly, the dosimeter 49 should be placed as close as possible to the structure 34. It is possible that the best layout would include a nozzle 25 with the dosimeter 49 and the decontamination device 51 at its two sides, the nozzle 25 being slightly further forward.

After recognizing the shape and position of the structure 34 by means of the induction sensor and after preparing the cutting trajectory or even during this shape recognition (by creation of a cutting plan which may be followed by a step in which this plan is modified after the shape and position recognition), therefore measurements of the contamination of structure 34 are made by dosimeter 49; if it is decided that decontamination is necessary, this decontamination will be done before cutting and therefore consists of putting the spinning head 52 in front of the excessively contaminated regions of structure 34, until the dosimeter 49 detects that contamination has dropped below a conventional limit. If necessary, an overall decontamination may be done followed by new measurements using dosimeter 49, after which the decontamination device jet 51 will be reapplied to locations that have not been decontaminated. The structure 34 can then be cut. When part of the structure 34 is detached, it is held in place by a sling, lifted and removed from the pool 10 and inserted into a storage barrel by means of a traveling crane or another device of this type. The combination of the decontamination device 51, the dosimeter 49 and the nozzle 25 on the same mobile equipment makes it possible to quickly, reliably and selectively decontaminate the structure to be cut; this would be more difficult to accomplish with separate devices that would probably be kept in operation much longer to be sure that the work was done satisfactorily (partly due to the lack of a dosimeter to measure the initial contamination and then its reduction, and partly due to the lack of a sensor to ensure that decontamination is being done sufficiently closely). With the invention, it is possible not to detach any part for which the radioactivity exceeds a fixed value, and which would subsequently introduce difficulties in processing.

FIG. 5 shows how the invention can be adapted to make it usable in a cutting process outside the containment offered by the aqueous environment of a pool. Some of the elements are unchanged and have the same references; these are the nozzle holder 24, the induction sensor pipe 37, and the elements used to create the abrasive liquid jet and to move the nozzle holder 24.

The structure 34 is now placed on a bowl-shaped jet breaking device 101, the bottom of which is fitted with a number of pyramids against which water bounces and loses its energy before flowing between the pyramids at the bottom of the bowl and passing through a prefiltration sieve 102 that retains the largest impurities. Water then enters a funnel 103 and then a filter 104 capable of stopping solid particles with a diameter between 5 and 100 $\mu$m that remain in a sieve bag 105 suspended above the bottom of the filter 104 and which forms its active element; the filtered and purified water output from the sieve bag 105 flows in the bottom of the filter 104 and then exits through a pipe 106 that may be closed by valve 107 and that terminates in a drainage installation; periodically opening valve 107 empties all liquid from filter 104. Another essential element that is modified in this embodiment is the layout of the suction retrieval device which in this case ends in a confinement housing 100 surrounding the nozzle support 24 so that only part of structure 34 corresponding to the cutting area is covered.

A hopper 108 opens up into the volume surrounded by the confinement hopper 100 making it possible to draw in cutting aerosols; its other end terminates in a cyclonic filter 109 fitted with a lower sieve bag 110 capable of retrieving cutting and sand particles; water flowing below bag 110 may then be emptied periodically from the cyclonic filter 109 through a pipe 111 leading to the drain installation, when a valve 112 is open. Under these-circumstances, a valve 113 located on an intake pipe 114 is closed, the intake pipe discharging towards the top of the cyclonic filter 109 and through which moist air passes out of this filter to enter the air-water separator 115 (in the bottom of which there is another pipe 116 leading to the drain installation and that can be closed by a valve 117), where it is dried. The dry air at the outlet from the air-water separator 115 passes through a pipe 118, another valve 119 being placed on this pipe to stop suction when required, and passes through a suction device 120 before being discharged into an outlet pipe 121.

The installation is capable of completely processing part of a nuclear installation to be dismantled, including the thickest parts with the most complicated shape; in particular cutting is possible for metals, ceramic and glass.

What is claimed is:

1. Installation for remote dismantling of irradiated structures comprising a support (35) for the structure (34), a module carrying a cutting head (24) forming part of a device spraying pressurized water and abrasive particles, characterized in that the module can be moved and rotated in front of the structure, and that the module supports a remote structure sensor (36, 37), a dosimeter (49) and a decontamination device (51).

2. Installation for remote dismantling of irradiated structures according to claim 1, characterized in that the structure and the module are immersed in a liquid.

3. Installation for remote dismantling of irradiated structures according to claim 1, characterized in that it comprises at least one structure observation camera (19, 191).

4. Installation for remote dismantling of irradiated structures according to claim 3, characterized in that the observation camera is placed so as to observe the mobile module.

5. Installation for remote dismantling of irradiated structures according to claim 1, characterized in that the remote structure sensor (36, 37) is a sensor coaxial with the cutting head.

6. Installation for remote dismantling of irradiated structures according to claim 1, characterized in that the decontamination device is a spinning head (52) spraying pressurized water.

7. Installation for remote dismantling of irradiated structures according to claim 1, characterized in that the mobile module can be moved around the entire structure (34) and can be rotated in all directions.

8. Installation for remote dismantling of irradiated structures according to claim 1, characterized in that it comprises a device for recovering abrasive particles and cutting residue.

9. Installation for remote dismantling of irradiated structures according to claim 8, characterized in that the recovery device is fitted with filters (43, 45).

10. Installation for remote dismantling of irradiated structures according to claim 9, characterized in that the recovery device comprises means of cleaning filters by washing.

11. Installation for remote dismantling of irradiated structures according to claim 8, characterized in that the recovery device includes a jet breaking device (101).

* * * * *